United States Patent [19]

Ohi

[11] 3,963,187

[45] June 15, 1976

[54] WRINKLE-PROOF MECHANISM FOR PAPER ROLL SUPPLY

[76] Inventor: Tadao Ohi, No. 315, Miyashita, Fuji, Shizuoka, Japan

[22] Filed: May 22, 1974

[21] Appl. No.: 472,147

[52] U.S. Cl. ..... 242/55; 242/56.2; 242/58; 242/75

[51] Int. Cl.[2] ..... B65H 19/04; B65H 35/02

[58] Field of Search ..... 242/58, 58.6, 76, 55, 242/56 AR, 56.6, 67.3, 68, 75, 75.2, 56.2

[56] References Cited

UNITED STATES PATENTS

| | | | |
|---|---|---|---|
| 471,788 | 3/1892 | Fransworth | 242/58 |
| 2,599,720 | 6/1952 | Prevost | 242/58.6 |
| 3,600,252 | 8/1971 | Henley et al. | 242/58 X |
| 3,601,327 | 8/1971 | Baumann | 242/55 |
| 3,695,532 | 10/1972 | Lindstaedt | 242/55 |

*Primary Examiner*—Stanley N. Gilreath
*Assistant Examiner*—John M. Jillons
*Attorney, Agent, or Firm*—Hill, Gross, Simpson, Van Santen, Steadman, Chiara & Simpson

[57] ABSTRACT

This invention provides a wrinkle-proof mechanism for a paper roll supply to a cutter in which a plurality of paper rolls are arranged linearly in two vertical stages and whereby the paper strip unwound from any one of said paper rolls excluding the foremost positioned roll is guided preferably linearly over the forwardly positioned paper roll or rolls to a fixed roller so that said paper strip will not hold or embrace the forwardly positioned paper roll or rolls. Movable rollers are provided between the foremost positioned paper rolls and said fixed roller, said movable rollers being arranged to move downward in proportion to the diameter of the paper roll decrease so that the angle at which said paper strip holds the foremost positioned paper roll is sharply reduced to thereby keep the paper strip free of wrinkles and reduce the braking force of the foremost paper roll.

6 Claims, 3 Drawing Figures

A
B
1
1'
2
3
3'
4
4'
5
5'
6
6'
7
8
9
10
11
12
12'
a
a'
θ

WRINKLE-PROOF MECHANISM FOR PAPER ROLL SUPPLY

DESCRIPTION OF THE PRIOR ART

In the paper roll suppliers of the prior art, as diagrammatically illustrated in FIG. 3 of the drawings, a paper strip *a* from each of the lower stage paper rolls 1' is guided to a fixed roller 2 after passing over the upper stage paper roll or rolls 1 which may also feed paper strips *a*. Therefore, the paper strip *a* from any of the rearwardly positioned paper rolls 1' will embrace the upper stage paper roll or rolls 1 to exert a jerking force thereto, so that the braking force for each of the upper stage paper rolls 1 must be increased sufficiently to resist this jerking force. Particularly, the foremost upper stage paper roll 1 is embraced by the strips of paper *a* from all of the rearwardly positioned lower stage paper rolls 1' and receives the combined jerking forces of all of said paper strips, and hence the braking force for this foremost paper roll 1 must be strengthened enough to meet said combined jerking forces exercised by the rearwardly positioned lower stage paper rolls 1'. Thus, in these prior art paper roll suppliers, paper would be tensioned far greater than the optimal tension and such extra tension would give rise to wrinkles in one or more of the paper strips, resulting in reduced quality of paper. Also, since more than a few wrinkled paper sheets appear in the cut paper sheets, a selecting procedure is required for eliminating such wrinkled paper sheets.

Further, in these paper roll suppliers, since the roller for guiding the paper to the cutter is fixed, the angle at which the paper embraces the foremost paper roll is gradually decreased with diminishment of the paper roll diameter as paper feed advances, causing corresponding decrease of the pulling force of the respective paper rolls. Therefore, to uniformly tension the paper, the braking force for each paper roll must be readjusted to take into account a decrease of the pulling force. Thus, unmanned operation of these paper roll suppliers is practically impossible, and an artificial adjustment of the braking force inevitably leads to some change in the paper, resulting in unstable paper feed velocity and non-uniform cut length of paper.

SUMMARY OF THE INVENTION

The present invention proposes an improved paper roll supply mechanism for a cutter comprising a plurality of paper rolls arranged linearly in two upper and lower stages, wherein the paper fed from any of the paper rolls except for the roll nearest the cutter is guided preferably linearly over the intervening paper roll or rolls toward a fixed guide roller so that the paper being fed will not embrace but will merely rest in gentle, linear contact with the preceding or intervening paper roll or rolls, so as to preclude jerking of the paper rolls by the moving paper thereby to minimize the required braking force for any of the intervening paper rolls. Also, the embracing or holding angle of the paper on the foremost paper roll nearest the cutter, which receives the combined jerking or impulse forces of all of the rearwardly positioned paper rolls, is confined to a minimum by specific arrangement of movable rollers to reduce the contact force and minimize jerking of the foremost paper roll, thus allowing maintenance of optimal tension in the paper fed from the paper rolls to the cutter and perfect wrinkle prevention in the paper. This not only creates a marked improvement of the cut paper quality but also dispenses with selecting work for eliminating the wrinkled papers.

According to the disclosed arrangement of this mechanism, the movable rollers provided between the fixed roller in the cutter assembly and the foremost paper rolls are suitably moved in conformity with the decrease of the paper roll diameter so as to keep constant the angle of deflection caused by the foremost upper or lower stage paper roll nearest the cutter. It is therefore possible to automatically maintain uniform paper tension by merely detecting the variation of paper tension by a detector and adjusting the braking force accordingly. Hence, unmanned operation of the paper rolls is possible. Further, if tension is automatically kept constant, stable, constant-speed paper feed can be achieved and hence accurate paper cutting with no error in cut size results.

DETAILED DESCRIPTION OF THE INVENTION

The invention is now described in detail by way of an embodiment thereof with reference to the accompanying drawings.

Figure 1:
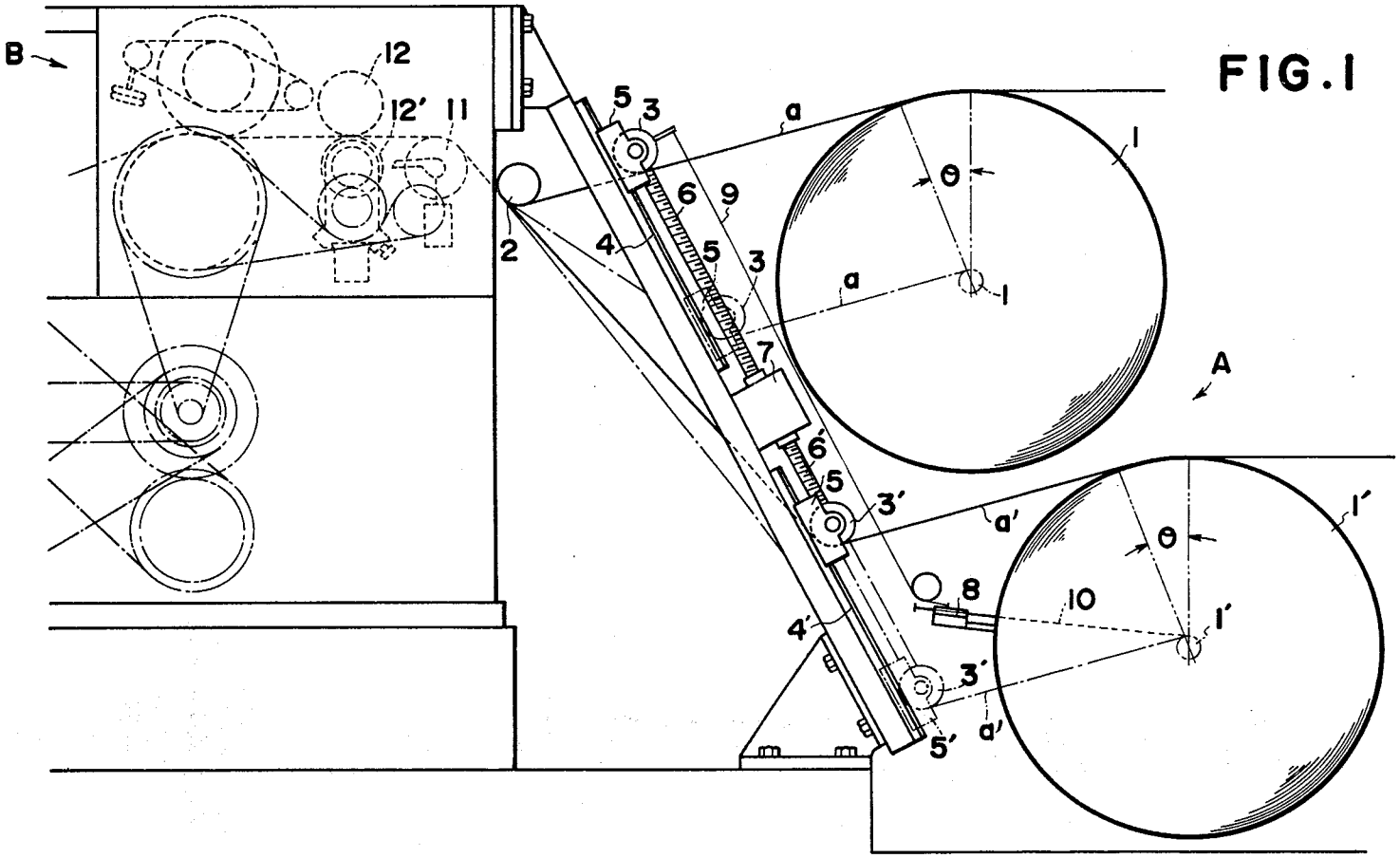
FIG. 1 is a fragmentary side view of the present invention.
Figure 2:
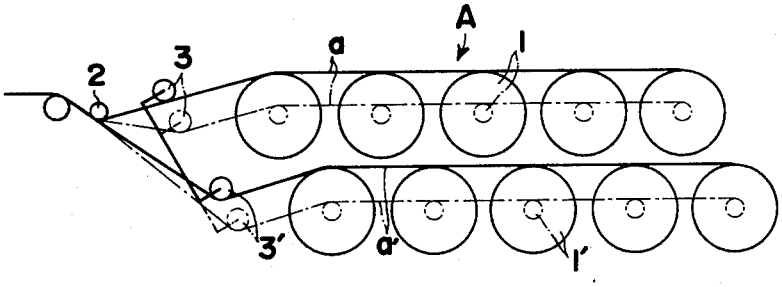
FIG. 2 is a side view of the present invention.
Figure 3:
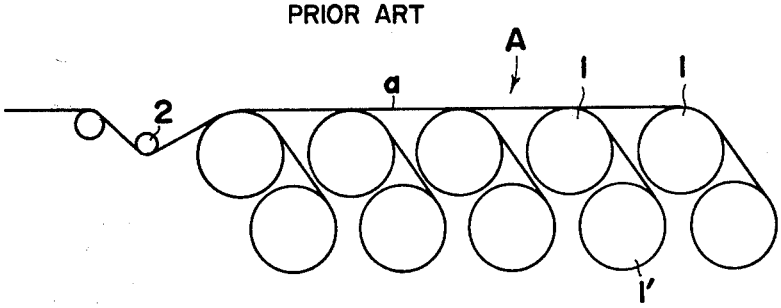
FIG.3 PRIOR ART
FIG. 3 is a side view of a prior art paper roll feed to a cutter.

Referring to the drawings, letter A indicates a paper roll supply assembly comprising a plurality of upper and lower stage paper rolls 1 and 1' arranged linearly. The upper and lower paper strips *a* and *a'* from the paper rolls in the upper and lower stages are guided over the forwardly positioned paper rolls 1 and 1' to a fixed roller 2 in the cutter unit B so that the paper strip from any rearwardly positioned paper roll will loosely contact the intervening paper roll or rolls. Between the foremost paper rolls of both upper and lower lines of rolls 1 and 1' and the fixed roller 2 are provided movably rollers 3, 3' supported by bearings 5, 5' engaged with lift guides 4, 4' provided in slanting fashion in front of said lines of paper rolls 1, 1'. Said bearings 5, 5' supporting the movable rollers 3, 3' move up or down along the guides 4, 4' by a lift mechanism comprising feed screws 6, 6' or such. When the lift mechanism is turned by a reduction gear motor 7, the movable rollers 3, 3' are simultaneously moved downwards through an equivalent distance to stabilize the angle $\theta$ at which the paper strips a, a' embrace the foremost paper rolls in the upper and lower stages. There is also provided a detector 8 for detecting the reduction of diameter of the lower stage paper roll nearest the cutter.

This detector 8 may be constructed by using a microswitch slidably attached to a slant guide 10, as illustrated in FIG. 1 by a dotted and solid line. The slant guide 10 has one end attached near the central rotating axis of the roll 1' and is positioned adjacent the hidden side of the roll. The other end of guide 10 is slightly raised above horizontal and has the detector 8 slidably attached thereto. A connecting member 9, such as a wire, connects the microswitch to the bearing 5 of the movable roller 3.

A finger of the microswitch abuts against the periphery of the roll 1'. As the diameter of the roll 1' decreases, the finger of the microswitch actuates the microswitch to operate motor 7 and move rollers 3, 3' downwardly. Microswitch 8 slides down guide 10 as the connecting member 9 translates until the finger of the microswitch again abuts the periphery of roll 1' and switches off the motor 7. The detector 8 operates in combination with motor 7 and rollers 3, 3' to maintain a constant embracing angle $\theta$ defined by the strips *a, a'* over the paper rolls 1, 1' by causing the rollers 3, 3' to translate by an amount equal to the radius change of the roll 1'. It should be understood by those skilled in the art that other types of detectors such as a photodetector may be employed in place of the microswitch 8. Numeral 11 refers to a paper tension detecting roll provided in front of a pair of slitters 12, 12' in the cutter assembly B. This paper tension detecting roll 11 is designed to detect the tension of the paper strip brought into said slitters 12, 12' through the fixed roller 2, and when any change in paper tension is detected, a suitable pressure adjusting mechanism (not shown) is operated to automatically adjust the braking force of an air brake (not shown) adapted to brake motion of the paper rolls 1, 1'.

ACTION AND EFFECT OF THE INVENTION

In operation of the present invention of which one embodiment was described hereabove, the paper strips *a* and *a'* are unwound from the respective paper rolls 1 and 1' in the upper and lower lines of rolls and guided to gently pass over the preceding paper rolls 1, 1' to the movable rollers 3, 3', and then they are further passed round the underside of the fixed roller 2 and fed into the cutter assembly B. The paper strips *a* and *a'* don't firmly embrace any of the intervening paper rolls 1 and 1' but merely slide over the paper rolls in linear fashion, and hence no jerking or impulse forces are exerted to the preceding paper rolls, so that the braking force for any of the preceding paper rolls can be set at the same value as that for the rearwardly positioned paper rolls. Further, if the embracing angle $\theta$ of the paper strips *a, a'* over the respective foremost paper rolls 1, 1' is set at the smallest possible value through suitable arrangement of the movable rollers 3, 3', the combined jerking or impulse force given to the respective foremost paper rolls by the paper strips drawn out from the plurality of rearwardly positioned paper rolls is also greatly reduced. Therefore, the braking force required for these foremost paper rolls 1, 1' is only slightly greater than that required for the other paper rolls, and hence the tension of each paper strip supplied into the cutter assembly can be optimally controlled for the paper quality to preclude formation of any wrinkle in the paper strip. This allows so-called wrinkle-free paper feed and marked improvement of the cut paper quality. Further, since there is no possibility of wrinkled papers to mix in the cut papers, no selecting work for removing such wrinkled papers is required. Moreover, according to the present device, when the paper rolls 1, 1' are reduced in diameter as paper feed advances, such reduction of diameter is detected by the microswitch detector 8 and the reduction gear motor 7 is operated to move the movable rollers 3, 3' downward by the lift mechanism 6, 6' by an amount corresponding to the reduction of diameter of said paper rolls 1, 1' so that the embracing angle $\theta$ of the paper strips *a, a'* over the respective paper rolls 1, 1' is always maintained constant so that the jerking or impulse force applied to the paper rolls by the paper strips unwinding from the rearwardly positioned paper rolls is also kept constant. Thus, paper tension can be kept constant through suitable adjustment of the braking force corresponding to the paper tension by detecting the change of paper tension and operating the tension controlling mechanism by the tension detecting roller 11. This allows unmanned operation of the paper roll feed and also automatic control of paper tension permits a stable constant-speed paper feed, thus realizing extremely accurate paper cutting with no error in size.

What is claimed is:

1. A wrinkle-proof apparatus for supplying strips of paper from any of a plurality of paper rolls to a cutter, comprising:

a. a plurality of paper rolls arranged linearly in upper and lower vertical stages, each stage having a foremost paper roll near the cutter;

b. at least one paper strip fed from at least one roll in each stage, said paper strip being guided linearly over the paper rolls between the foremost paper roll and the paper roll feeding the paper strip, said strip fed from each stage being guided only along rollers of the same stage;

c. a movable roller means between the cutter and the upper and lower stage foremost rolls for deflecting the paper strips and causing said paper strips to embrace said foremost rolls over a predetermined embracing angle;

d. detecting means responsive to a change in the diameter of one of the foremost paper rolls; and e. movement means activated by said detecting means for causing said movable roller means to change position in correspondence with said diameter change of one of the foremost paper rolls to maintain said embracing angle substantially constant.

2. A paper roll supply apparatus of claim 1 in which a stationary roller means is provided between said movable roller means and the cutter.

3. A paper roll supply apparatus of claim 1, in which paper strips from all the paper rolls in the upper and lower stages embrace said foremost rolls.

4. A paper roll supply apparatus of claim 1 in which said movable roller means comprises two movable rollers, one aligned with the upper and the other with the lower stage, and slanting lift guides having bearings provided therein, said lift guides supporting said two movable rollers.

5. A paper roll supply apparatus of claim 1 in which said movable roller means comprises two rollers, and a lift guide mechanism for guiding said rollers for movement relative to said rolls, and wherein said movement means comprises a motor for moving said two rollers.

6. A paper roll supply apparatus of claim 5 in which said detecting means comprises a microswitch, a slant guide positioned adjacent one of said foremost paper rolls for slidably supporting said microswitch for movement under the force of gravity into engagement with the periphery of said one foremost paper roll, and a connection means for connecting said microswitch to one of said rollers.

* * * * *